US009702363B2

(12) United States Patent
Higuchi

(10) Patent No.: US 9,702,363 B2
(45) Date of Patent: Jul. 11, 2017

(54) COMPRESSOR

(71) Applicant: DAIKIN INDUSTRIES, LTD., Osaka-shi, Osaka (JP)

(72) Inventor: Masahide Higuchi, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/103,262

(22) PCT Filed: Dec. 3, 2014

(86) PCT No.: PCT/JP2014/081963
§ 371 (c)(1),
(2) Date: Jun. 9, 2016

(87) PCT Pub. No.: WO2015/087754
PCT Pub. Date: Jun. 18, 2015

(65) Prior Publication Data

US 2016/0356272 A1 Dec. 8, 2016

(30) Foreign Application Priority Data

Dec. 13, 2013 (JP) ..... 2013-258255
Nov. 14, 2014 (JP) ..... 2014-231975

(51) Int. Cl.
*F04C 18/00* (2006.01)
*F04C 27/00* (2006.01)
(Continued)

(52) U.S. Cl.
CPC ..... *F04C 18/3568* (2013.01); *F01C 21/02* (2013.01); *F04C 18/356* (2013.01);
(Continued)

(58) Field of Classification Search
CPC .... F01C 21/02; F04C 18/356; F04C 18/3568; F04C 29/0057
(Continued)

(56) References Cited

U.S. PATENT DOCUMENTS 2,800,274 A 7/1957 Makaroff et al.
3,877,127 A * 4/1975 Takahashi ..... B23P 15/00 29/445
(Continued)

FOREIGN PATENT DOCUMENTS

CN 101688535 A 3/2010
JP 9-184494 A 7/1997
(Continued)

OTHER PUBLICATIONS

International Preliminary Report of corresponding PCT Application No. PCT/JP2014/081963 dated Jun. 23, 2016.
(Continued)

*Primary Examiner* — Mark Laurenzi
*Assistant Examiner* — Anthony Ayala Delgado
(74) *Attorney, Agent, or Firm* — Global IP Counselors, LLP

(57) ABSTRACT

A compressor includes a cylinder, a shaft including a main shaft and an eccentric part, a roller part having an inner circumferential surface fitted on an outer circumferential surface of the eccentric part so as to make an orbital motion, a blade part along with the roller part partitioning inside of the cylinder chamber into low and high pressure chambers, and sliding bearing parts fixed to the cylinder and including cylindrical surfaces supporting the main shaft. A relation $(\phi Ds-\phi Dr)/2<\epsilon$ is satisfied. $\phi Ds$ is an inside diameter of the inner circumferential surface of the cylinder chamber, $\phi Dr$ is an outside diameter of the outer circumferential surface of the roller part, and $\epsilon$ is an eccentricity of a central axis of the eccentric part relative to a central axis of the main shaft. Central axes of the cylindrical surfaces are eccentric relative to a central axis of the inner circumferential surface.

7 Claims, 6 Drawing Sheets

(51) Int. Cl.

| | |
|---|---|
| ***F04C 18/356*** | (2006.01) |
| ***F01C 21/02*** | (2006.01) |
| ***F04C 29/00*** | (2006.01) |
| ***F04C 18/38*** | (2006.01) |
| ***F04C 29/02*** | (2006.01) |

(52) U.S. Cl.
CPC ..... *F04C 18/38* (2013.01); *F04C 29/0057* (2013.01); *F04C 29/021* (2013.01); *F04C 2210/268* (2013.01); *F04C 2240/30* (2013.01); *F04C 2240/50* (2013.01); *F04C 2240/56* (2013.01); *F04C 2240/60* (2013.01)

(58) Field of Classification Search
USPC ..... 418/11, 23–27, 60, 63, 150, 270
See application file for complete search history.

(56) References Cited

U.S. PATENT DOCUMENTS

| | | | | |
|---|---|---|---|---|
| 4,395,208 | A * | 7/1983 | Maruyama | F04C 27/001 418/102 |
| 4,743,182 | A | 5/1988 | Schabert | |
| 4,883,414 | A | 11/1989 | Schabert | |
| 4,895,501 | A * | 1/1990 | Bagepalli | F04C 18/3564 418/248 |
| 6,132,195 | A * | 10/2000 | Ikoma | F04C 18/3564 418/67 |
| 6,435,850 | B2 * | 8/2002 | Sunaga | F01C 21/0809 418/178 |
| 7,780,426 | B2 | 8/2010 | Cho et al. | |
| 2010/0147013 | A1 | 6/2010 | Hirayama | |

FOREIGN PATENT DOCUMENTS

| | | | |
|---|---|---|---|
| JP | 11-166494 | A | 6/1999 |
| JP | 2003-214369 | A | 7/2003 |
| JP | 2008-232000 | A | 10/2008 |

OTHER PUBLICATIONS

European Search Report of corresponding EP Application No. 14 87 0462.0 dated Sep. 16, 2016.
International Search Report of corresponding PCT Application No. PCT/JP2014/081963 dated Mar. 17, 2015.

* cited by examiner

COMPRESSOR

CROSS-REFERENCE TO RELATED APPLICATIONS

This U.S. National stage application claims priority under 35 U.S.C. §119(a) to Japanese Patent Application Nos. 2013-258255, filed in Japan on Dec. 13, 2013, and 2014-231975, filed in Japan on Nov. 14, 2014, the entire contents of which are hereby incorporated herein by reference.

TECHNICAL FIELD

The present invention relates to a compressor.

BACKGROUND ART

A conventional compressor is disclosed in JP 2003-214369 A. The compressor includes a cylinder having a cylinder chamber, a shaft having an eccentric part, and a roller piston having a roller part, the eccentric part located in the cylinder chamber, the roller part fitted on the eccentric part. The roller part revolves in the cylinder chamber and refrigerant in the cylinder chamber is thereby compressed.

An inner circumferential surface of the cylinder chamber is formed in a noncircular shape with a plurality of curvatures in section, and a radial clearance (which will be referred to as "CP clearance" hereinbelow) between an outer circumferential surface of the roller part and the inner circumferential surface of the cylinder chamber during operation is made so small that reduction in leakage loss of the refrigerant and efficiency improvement are attained.

SUMMARY

Technical Problem

In the conventional compressor, however, the inner circumferential surface of the cylinder chamber is formed in the noncircular shape with the plurality of curvatures in section, and thus a processing machine subjected to advanced NC (numerical control), which entails much costs, is required for machining of the inner circumferential surface of the cylinder chamber. In addition, management of the shape of the machined cylinder for ensuring that the CP clearance is minute and uniform for one revolution of the roller part is troublesome and entails much costs.

An object of the invention is to provide a compressor in which efficiency can be improved by reduction in leakage loss of refrigerant and for which production costs and management costs can be reduced.

Solution to Problem

In order to achieve the object, a compressor of the invention comprises:

a cylinder including a cylinder chamber of which an inner circumferential surface is a substantially cylindrical surface, a shaft including a main shaft and an eccentric part which is eccentric to the main shaft, a roller part of which an inner circumferential surface is fitted on an outer circumferential surface of the eccentric part, of which an outer circumferential surface is a substantially cylindrical surface, and which is placed in the cylinder chamber so as to make an orbital motion, a blade part which, along with the roller part, partitions inside of the cylinder chamber into a low-pressure chamber and a high-pressure chamber, and bearing parts which are fixed to the cylinder and which respectively include cylindrical surfaces for supporting the main shaft, wherein a relation $(\phi Ds-\phi Dr)/2<\epsilon$ is satisfied, in which $\phi Ds$ is an inside diameter of the inner circumferential surface of the cylinder chamber, $\phi Dr$ being an outside diameter of the outer circumferential surface of the roller part, $\epsilon$ being an eccentricity of a central axis of the eccentric part to a central axis of the main shaft, wherein central axes of the cylindrical surfaces of the bearing parts are eccentric to a central axis of the inner circumferential surface of the cylinder chamber, and wherein the bearing parts are sliding bearings.

According to the compressor of the invention, it appears that the outer circumferential surface of the roller part is likely to collide with the inner circumferential surface of the cylinder chamber during operation because the relation $(\phi Ds-\phi Dr)/2<\epsilon$ holds, whereas the main shaft of the shaft moves by an amount corresponding to clearances between an outer circumferential surface of the main shaft and the cylindrical surfaces of the bearing parts during operation because the central axes of the cylindrical surfaces of the bearing parts are eccentric to the central axis of the cylindrical surface of the cylinder chamber and because the bearing parts are the sliding bearings, so that the outer circumferential surface of the roller part is prevented from colliding with the inner circumferential surface of the cylinder chamber and so that a radial clearance (which will be referred to as "CP clearance" hereinbelow) between the outer circumferential surface of the roller part and the inner circumferential surface of the cylinder chamber can be decreased.

The inner circumferential surface of the cylinder chamber and the outer circumferential surface of the roller part are substantially cylindrical and thus production costs and management costs can be reduced in comparison with configurations in which the inner circumferential surface of the cylinder chamber and the outer circumferential surface of the roller part are in noncircular shapes with a plurality of curvatures in section.

Thus reduction in leakage loss of refrigerant and resultant improvement in efficiency can be attained by decrease in the clearance between the outer circumferential surface of the roller part and the inner circumferential surface of the cylinder chamber during operation and production costs and management costs for the cylinder and a roller piston can be reduced.

In one embodiment, clearances between the cylindrical surfaces of the bearing parts and the outer circumferential surface of the main shaft are sized to such an extent that the main shaft is allowed to move so as to prevent the roller part from colliding with the inner circumferential surface of the cylinder chamber.

According to the embodiment, in which the clearances between the cylindrical surfaces of the bearing parts and the outer circumferential surface of the main shaft are sized to such an extent that the main shaft is allowed to move so as to prevent the roller part from colliding with the inner circumferential surface of the cylinder chamber in spite of satisfaction of the relation $(\phi Ds-\phi Dr)/2<\epsilon$ and eccentricity of the central axes of the cylindrical surfaces of the bearing parts to the central axis of the cylindrical surface of the cylinder chamber, the outer circumferential surface of the roller part is prevented from colliding with the inner circumferential surface of the cylinder chamber because the main shaft is allowed to move by the amount corresponding to the clearances, and the reduction in the leakage loss of the refrigerant and the resultant improvement in the efficiency can be attained by the decrease in the radial clearance between the outer circumferential surface of the roller part and the inner circumferential surface of the cylinder chamber.

In one embodiment, the roller part and the blade part are integrated and form a roller piston, and wherein both side surfaces of the blade part are swingably supported by swing bushes.

In the compressor of the embodiment, which is a so-called swing piston type compressor having the roller part and the blade part integrated, the outer circumferential surface of the roller part is prevented from colliding with the inner circumferential surface of the cylinder chamber and the radial clearance between the outer circumferential surface of the roller part and the inner circumferential surface of the cylinder chamber can be decreased, so that the efficiency can be improved by the reduction in the leakage loss of the refrigerant.

In one embodiment, the roller part and the blade part are separated, wherein the blade part protrudes into the cylinder chamber so as to be capable of reciprocating, and wherein an extremity of the blade part is in sliding contact with the outer circumferential surface of the roller part.

In the compressor of the embodiment, which is a so-called rotary piston type compressor having the roller part and the blade part separated, the outer circumferential surface of the roller part is prevented from colliding with the inner circumferential surface of the cylinder chamber and the radial clearance between the outer circumferential surface of the roller part and the inner circumferential surface of the cylinder chamber can be decreased, so that the efficiency can be improved by the reduction in the leakage loss of the refrigerant.

In one embodiment, in a section orthogonal to the central axis of the inner circumferential surface of the cylinder chamber with the central axis of the cylinder chamber defined as an origin, with a straight line linking a central axis of swing of the swing bushes and the central axis of the cylinder chamber or a straight line linking a center plain between both the side surfaces of the blade part separate from the roller part and the central axis of the cylinder chamber defined as a reference line, and with an angle formed by a radius vector that extends from the origin and that revolves in a direction of the orbital motion of the roller part with the reference line in the direction of the orbital motion defined as a central angle, the central axes of the cylindrical surfaces of the bearing parts are eccentric to the central axis of the inner circumferential surface of the cylinder chamber at the central angle in a range from 270° to 360°.

According to the compressor of the embodiment, the central axes of the cylindrical surfaces of the bearing parts are eccentric to the central axis of the inner circumferential surface of the cylinder chamber at the central angle in the range from 270° to 360°.

Thus the central axes of the cylindrical surfaces of the bearing parts are eccentric to the central axis of the inner circumferential surface of the cylinder chamber at the central angle in the range from 270° to 360° and the roller part 26 is accordingly eccentric in a direction toward the inner circumferential surface of the cylinder chamber at a revolution angle in the range of the central angle from 270° to 360° that is close to last of a compression stroke and that subjects the roller part to the highest pressure of the refrigerant in the orbital motion of the roller part, so that the leakage loss of the refrigerant having the high pressure can effectively be reduced in particular by the reduction in the CP clearance between the inner circumferential surface of the cylinder chamber and the outer circumferential surface of the roller part.

In one embodiment, refrigerant that is made to flow into the cylinder chamber is R32.

According to the compressor of the embodiment, the refrigerant that is made to flow into the cylinder chamber is R32 and thus environmental impact of the refrigerant can be reduced.

Though R32 has a tendency to have temperature easily increased by being compressed, leakage of the refrigerant, in particular, leakage of the refrigerant having high pressure can be reduced by the embodiment and thus increase in the temperature of the refrigerant that is caused by the leakage of the refrigerant having the high pressure to a suction side can be reduced.

A compressor of the invention includes the cylinder having the cylinder chamber, the shaft including the main shaft, and the eccentric part that is fixed to the main shaft and that is located in the cylinder chamber, the roller piston having the roller part that is fitted on the eccentric part, and the bearing parts that are fixed to the cylinder and that support the main shaft, the relation $(\phi Ds-\phi Dr)/2<\epsilon$ is satisfied, in which $\phi Ds$ is the inside diameter of the inner circumferential surface in shape of the perfect circle in section of the cylinder chamber, $\phi Dr$ being the outside diameter of the outer circumferential surface in shape of the perfect circle in section of the roller part, $\epsilon$ being the eccentricity of the eccentric part to the main shaft, the centers of the bearing parts are eccentric to the center of the cylinder chamber, and the bearing parts are sliding bearings.

According to the compressor of the invention, it appears that the roller part is likely to collide with the inner circumferential surface of the cylinder chamber because the relation $(\phi Ds-\phi Dr)/2<\epsilon$ holds, whereas the shaft moves by the amount corresponding to the clearances between the shaft and the bearing parts during operation because the centers of the bearing parts are eccentric to the center of the cylinder chamber and because the bearing parts are the sliding bearings. Thus the roller part is prevented from colliding with the inner circumferential surface of the cylinder chamber and the radial clearance (which will be referred to as "CP clearance" below) between the outer circumferential surface of the roller part and the inner circumferential surface of the cylinder chamber can be decreased. The inner circumferential surface of the cylinder chamber and the outer circumferential surface of the roller part each have the shape of the perfect circle, so that the production costs and the management costs can be reduced in comparison with configurations in which the inner circumferential surface of the cylinder chamber and the outer circumferential surface of the roller part are in noncircular shapes with a plurality of curvatures in section.

Thus the reduction in the leakage loss of the refrigerant and the resultant improvement in the efficiency can be attained by the decrease in the clearance between the outer circumferential surface of the roller part and the inner circumferential surface of the cylinder chamber during operation and the production costs and the management costs for the cylinder and the roller piston can be reduced.

In a compressor in accordance with an embodiment, as viewed in a direction along the center of the main shaft, the center of the cylinder chamber is defined as an origin, a central angle of a top dead center of the roller piston is defined as 0°, a direction of rotation of the roller piston is defined as a forward direction, and then the centers of the bearing parts are eccentric to the center of the cylinder chamber in a direction with the central angle not smaller than 270° and not greater than 360°.

According to the compressor of the embodiment, the centers of the bearing parts are eccentric to the center of the cylinder chamber in the direction with the central angle not smaller than 270° and not greater than 360°. Thus the centers of the bearing parts are made eccentric in the direction with a rotation angle of the roller piston at which the pressure of the refrigerant being compressed increases and thus the CP clearance corresponding to the rotation angle of the roller piston can be decreased, so that the leakage loss of the refrigerant having the high pressure can effectively be reduced.

In a compressor in accordance with an embodiment, the refrigerant that is made to flow into the cylinder chamber is R32.

According to the compressor of the embodiment, the refrigerant that is made to flow into the cylinder chamber is R32 and thus the environmental impact of the refrigerant can be reduced. Though R32 has the tendency to have compression temperature easily increased, the leakage of the refrigerant can foe reduced and thus the temperature of the refrigerant that is discharged from the cylinder can be decreased in the embodiment.

Advantageous Effects of Invention

According to the compressors of the invention, the efficiency can be improved by the reduction in the leakage loss of the refrigerant and the production costs and the management costs can be reduced because the relation $(\phi Ds-\phi Dr)/2<\epsilon$ holds, because the central axes of the cylindrical surfaces of the bearing parts are eccentric to the central axis of the inner circumferential surface of the cylinder chamber that is the cylindrical surface, and because the bearing parts are the sliding bearings.

DESCRIPTION OF EMBODIMENTS

Figure 1:
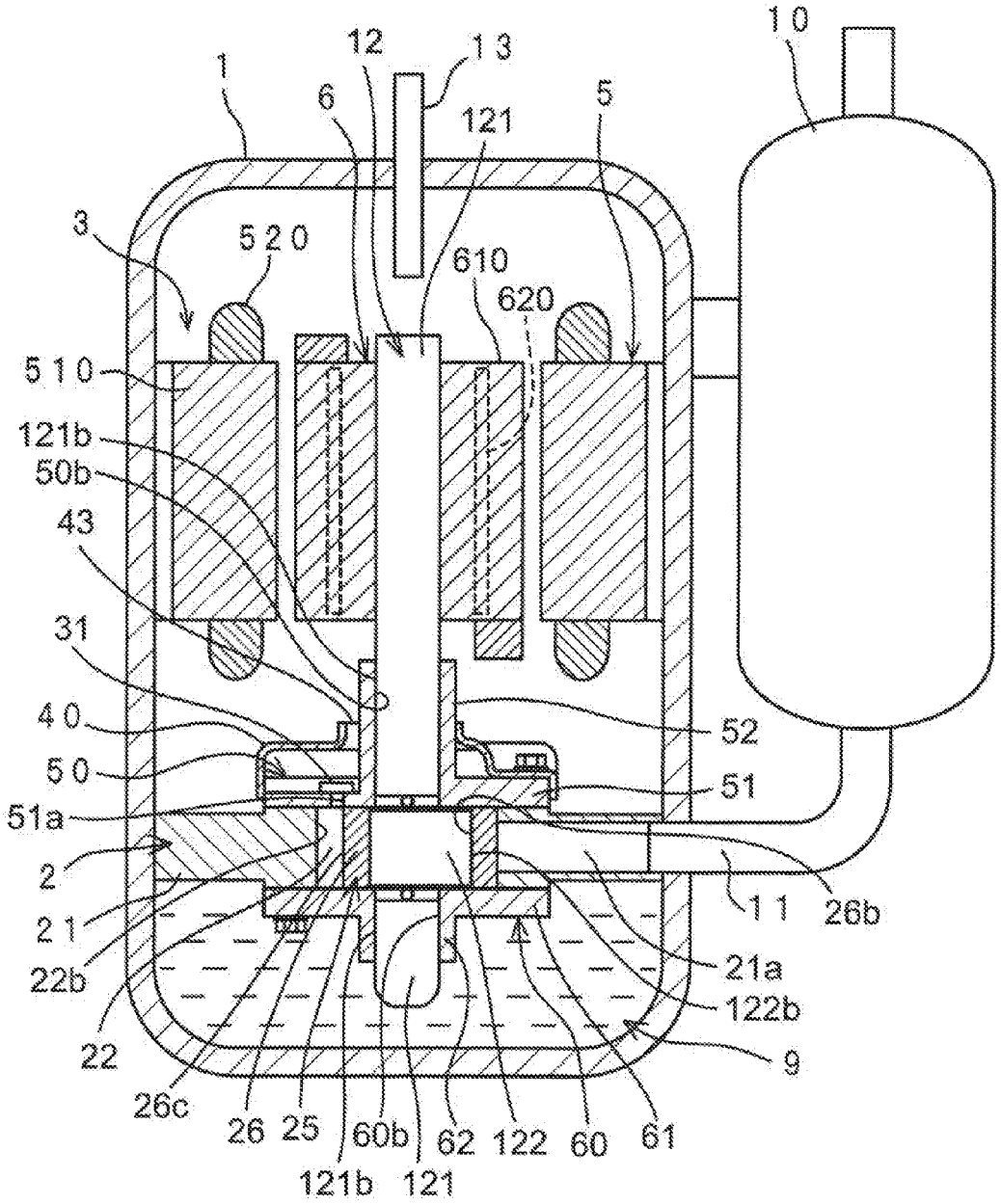
FIG. 1 is a vertical section showing a compressor in accordance with a first embodiment of the invention.

Hereinbeiow, the invention will be described in detail with reference to embodiments shown in the drawings.

First Embodiment

FIG. 1 shows a vertical section of a first embodiment of a compressor of the invention. The compressor includes an airtight container 1, a compression element 2 that is placed in the airtight container 1, and a motor 3 that is placed in the airtight container 1 and that drives the compression element 2 through a shaft 12.

The compressor is a so-called swing piston type compressor of vertically installed high-pressure dome type, having the compression element 2 placed on lower side and the motor 3 placed on upper side in the airtight container 1. The compression element 2 is driven through the shaft 12 by a rotor 6 of the motor 3.

The compression element 2 sucks in refrigerant gas from an accumulator 10 through a suction pipe 11. The refrigerant gas is obtained by control over the compressor and over a condenser, an expansion mechanism, and an evaporator not shown and forming an air conditioner as an example of a refrigeration system. R32 is used as the refrigerant. The refrigerant may be a single refrigerant made of R32 or may be a mixed refrigerant containing R32 as a principal ingredient.

In the compressor, the refrigerant gas compressed by the compression element 2 and having high temperature and high pressure is discharged from the compression element 2 so as to fill inside of the airtight container 1 while cooling the motor 3 by being passed through a clearance between a stator 5 and the rotor 6 in the motor 3, and is thereafter discharged to outside through a discharge pipe 13 provided on an upper side of the motor 3.

An oil sump 9 in which lubricating oil is accumulated is formed in a lower part of a high-pressure section in the airtight container 1. The lubricating oil travels from the oil sump 9 through an oil passage provided in the shaft 12 to sliding parts such as bearings of the compression element 2 and the motor 3, and the sliding parts are thereby lubricated. The lubricating oil is polyalkylene glycol oil (such as polyethylene glycol and polypropylene glycol), ether oil, ester oil, or mineral oil, for instance.

The motor 3 includes the rotor 6 and the stator 5 that is placed so as to encircle an outer circumferential side of the rotor 6.

The rotor 6 includes a cylindrical rotor core 610 and a plurality of magnets 620 embedded in the rotor core 610. The rotor core 610 is made of laminated magnetic steel sheets, for instance. The shaft 12 is fixed into a center bore of the rotor core 610. The magnets 620 are permanent magnets shaped like flat plates. The plurality of magnets 620 are arranged at equal intervals with equal central angles along a circumferential direction of the rotor core 610.

The stator 5 includes a cylindrical stator core 510 and coils 520 wound on the stator core 510. The stator core 510 is composed of a plurality of steel sheets that are laminated and is fitted into the airtight container 1 by shrinkage fit or the like. The coils 520 are wound on teeth parts of the stator core 510 and are formed by so-called concentrated winding.

The compression element 2 includes a front-side bearing part 50 and a rear-side bearing part 60 that both support the shaft 12, a cylinder 21 that is placed between the front-side bearing part 50 and the rear-side bearing part 60, and a roller piston 25 that is placed in the cylinder 21.

The cylinder 21 is fixed to an inner circumferential surface of the airtight container 1. The cylinder 21 includes a cylinder chamber 22 of which an inner circumferential surface 22*b* is a substantially cylindrical surface. The front-side bearing part 50 is placed on a side (upper side) nearer to the motor 3 with respect to the rear-side bearing part 60. The front-side bearing part 50 is fixed to an upper opening end of the cylinder 21 and the rear-side bearing part 60 is fixed to a lower opening end of the cylinder 21.

The shaft 12 includes a main shaft 121 and an eccentric part 122 that is fixed to the main shaft 121 and that is located in the cylinder chamber 22. The roller piston 25 is fitted on the eccentric part 122. The roller piston 25 is placed in the cylinder chamber 22 so as to be capable of making an orbital motion and eccentrically rotates in the cylinder chamber 22 so as to compress the refrigerant in the cylinder chamber 22.

The front-side bearing part 50 includes a disc-like end plate part 51 and a boss part 52 that is provided at center of the end plate part 51 and on a side (upper side) thereof opposed to the cylinder 21 and includes a cylindrical surface 50*b* that rotatably supports the main shaft 121. The boss part 52 supports the main shaft 121 of the shaft 12. The front-side bearing part 50 is a sliding bearing and lubricating oil intervenes in a radial clearance between the boss part 52 and the main shaft 121.

A discharge hole 51*a* communicating with the cylinder chamber 22 is provided in the end plate part 51. A discharge valve 31 is mounted in the end plate part 51 so as to be located opposite to the cylinder 121 with respect to the end plate part 51. The discharge valve 131, which is a reed valve, for instance, opens and closes the discharge hole 51*a*.

A cup-like muffler cover 40 is mounted on the end plate part 51 and opposite to the cylinder 121 so as to cover the discharge valve 31. The boss part 52 pierces the muffler cover 40.

Inside of the muffler cover 40 communicates with the cylinder chamber 22 through the discharge hole 51*a*. The muffler cover 140 has a hole part 43 that provides communication between the inside and outside of the muffler cover 40.

The rear-side bearing part 60 includes a disc-like end plate part 61 and a boss part 62 that is provided at center of the end plate part 61 and on a side (lower side) thereof opposed to the cylinder 21 and includes a cylindrical surface 60*b* that rotatably supports the main shaft 121. The boss part 62 supports the main shaft 121 of the shaft 12. The rear-side bearing part 60 is a sliding bearing and lubricating oil intervenes in a radial clearance between the boss part 62 and the main shaft 121.

Figure 2:
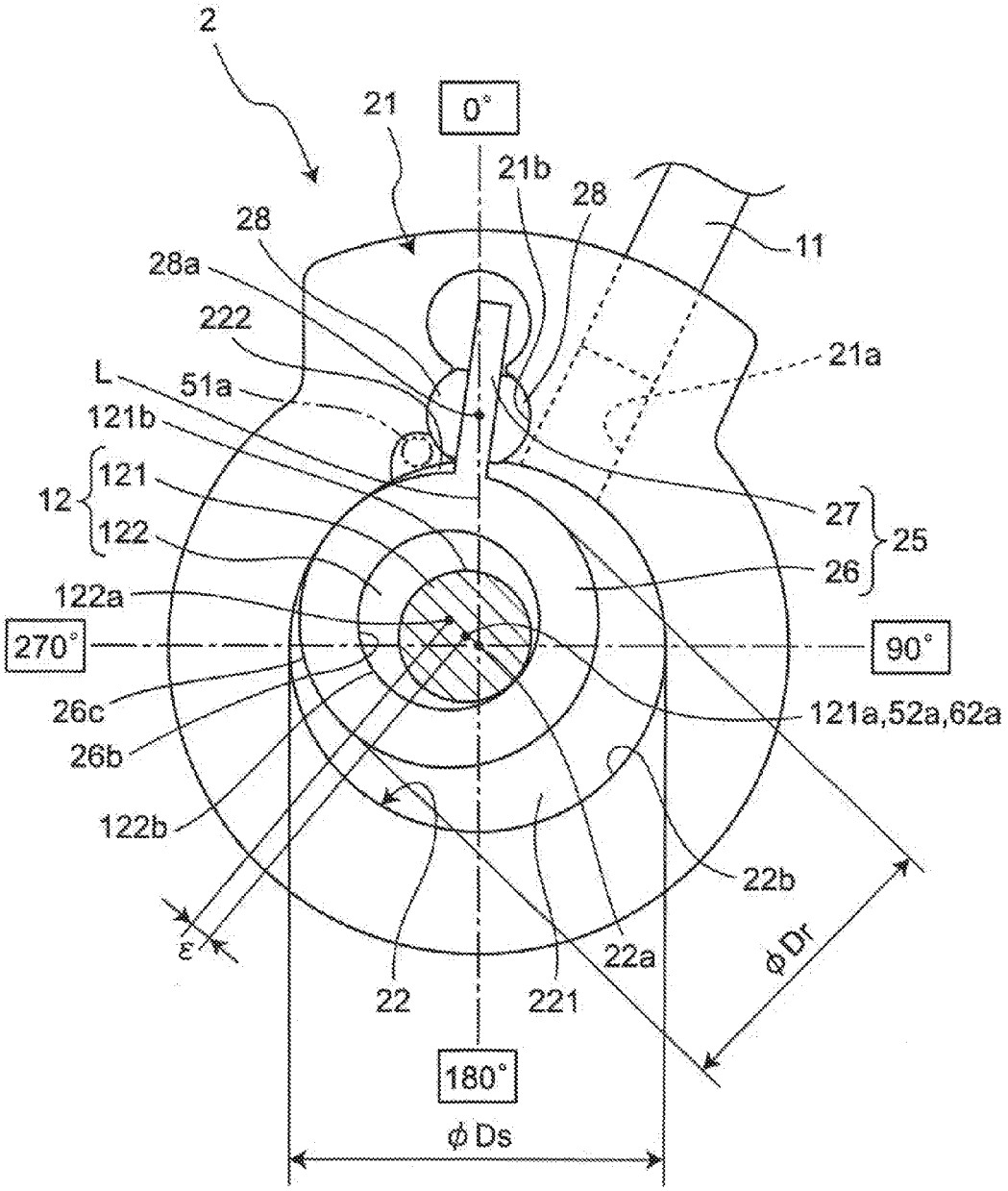
FIG. 2 is a plan view of a compression element.

FIG. 2 shows a plan view of the compression element 2. As shown in FIG. 2, the roller piston 25 includes a roller part 26 and a blade part 27 fixed onto an outer circumferential surface of the roller part 26.

Inside of the cylinder chamber 22 is partitioned by the blade part 27. The discharge hole 51*a* and a suction hole 21*a* with which the suction pipe 11 communicates open on the cylinder chamber 22.

The blade part 27 divides the cylinder chamber 22 into a low-pressure chamber (suction chamber) 221 communicating with the suction hole 21*a* and a high-pressure chamber (discharge chamber) 222 communicating with the discharge hole 51*a*. That, is, the chamber on a right side of the blade part 27 forms the low-pressure chamber 221 and the chamber on a left side of the blade part 27 forms the high-pressure chamber 222.

Semicylindrical swing bushes 28, 28 are in intimate contact with both surfaces of the blade part 27 so as to effect sealing. Lubrication between the blade part 27 and the swing bushes 28, 28 is effected by the lubricating oil.

The swing bushes 28, 28 are rotatably fitted in a bush fitting hole 21*b* that is formed so as to face the cylinder chamber 22 and swingably and reciprocatingly support the blade part 27 by holding the blade part 27 from both sides.

The roller part 26 is fitted on the eccentric part 122. With eccentric rotation of the eccentric part 122, the roller part 26 makes the orbital motion with the outer circumferential surface of the roller part 26 being in contact with the inner circumferential surface of the cylinder chamber 22.

With the orbital motion of the roller part 26 in the cylinder chamber 22, the blade part 27 reciprocates with both the side surfaces of the blade part 27 held by the swing bushes 28, 28. Accordingly, the refrigerant gas having low pressure is sucked from the suction pipe 11 into the low-pressure chamber 221, is then compressed in the high-pressure chamber 222 so as to have high pressure, and the refrigerant gas having the high pressure is thereafter discharged through the discharge hole 51*a*. The refrigerant gas discharged through the discharge hole 51*a* is expelled to the outside of the muffler cover 40.

The inner circumferential surface of the cylinder chamber 22 is in shape of a perfect circle in section and the outer circumferential surface of the roller part 26 is also in shape of a perfect circle in section. Therein, a relation $(\phi Ds-\phi Dr)/2<\epsilon$ is satisfied, in which $\phi Ds$ is an inside diameter of the inner circumferential surface of the cylinder chamber 22, $\phi Dr$ being an outside diameter of the outer circumferential surface of the roller part 26, $\epsilon$ being an eccentricity of a center 122*a* of the eccentric part 122 to a center 121*a* of the main shaft 121.

A center 52*a* of the front-side bearing part 50 (boss part 52) and a center 62*a* of the rear-side bearing part 60 (boss part 62) are eccentric to the center 22*a* of the cylinder chamber 22. Though the center 121*a* of the main shaft 121 coincides with the center 52*a* of the front-side bearing part 50 and the center 62*a* of the rear-side bearing part 60 in FIG. 2, the center 121*a* of the main shaft 121 during operation is at a position deviated from the center 52*a* of the front-side bearing part 50 and the center 62*a* of the rear-side bearing part 60 in a strict sense.

As viewed in a direction along the center 121*a* of the main shaft 121, the center 22*a* of the cylinder chamber 22 is defined as an origin, a central angle of a top dead center of the roller piston 25 is defined as 0°, a direction of rotation of the roller piston 25 is defined as a forward direction, and then the center 52*a* of the front-side bearing part 50 and the center 62*a* of the rear-side bearing part 60 are eccentric to the center 22*a* of the cylinder chamber 22 in a direction with a central angle not smaller than 270° and not greater than 360°. The top dead center of the roller piston 25 refers to a position the roller piston 25 reaches when the blade part 27 advances to the deepest position into the bush fitting hole 21*b*.

The discharge hole 51*a* opens at a position with a central angle close to 360° in a range from 270° to 360°. The suction hole 21*a* opens at a position with a central angle close to 0° in a range from 0° to 90°.

To sum up again configurations of the compressor, as shown in FIGS. 1 and 2, the inner circumferential surface of the cylinder chamber 22 of the cylinder 21 is the substantially cylindrical surface and the roller part 26 of the roller piston 25 is placed in the cylinder chamber 22. The roller part 26 and the blade part 27 of the roller piston 25 are integrally formed and the compressor is a so-called swing-type compressor. The outer circumferential surface 26*c* of the roller part 26 is a substantially cylindrical surface. The blade part 27 reciprocates toward and from the inside of the cylinder chamber 22 while swinging (oscillating) with both the side surfaces held by the swing bushes 23, 28 so as to allow the roller part 26 to make the orbital motion along the inner circumferential surface 22*b* of the cylinder chamber 22.

Thus the inside of the cylinder chamber 22 is partitioned into the low-pressure chamber 221 and the high-pressure chamber 222 by the roller part 26 and the blade part 27 and compression operation is achieved by the orbital motion of the roller part 26.

The shaft 12 includes the main shaft 121 and the eccentric part 122 that is eccentric to the main shaft 121. An inner circumferential surface 26*b* of the roller part 26 is rotatably fitted on an outer circumferential surface 122*b* of the eccentric part 122. Both the outer circumferential surface 122*b* of the eccentric part 122 and the inner circumferential surface 26*b* of the roller part 26 are cylindrical.

The front-side and the rear-side bearing parts 50 and 60 are respectively fixed to both end surfaces of the cylinder 21. The bearing parts 50, 60 are the sliding bearings respectively including the cylindrical surfaces 50*b*, 60*b* that rotatably support the main shaft 121 of the shaft 12.

Therein, the relation $(\phi Ds-\phi Dr)/2<\epsilon$ is satisfied, in which $\phi Ds$ is the inside diameter of the inner circumferential surface 22*b* of the cylinder chamber 22, $\phi Dr$ being the outside diameter of the outer circumferential surface 26*c* of the roller part 26, $\epsilon$ being the eccentricity of the central axis 122*a* of the eccentric part 122 to the central axis 121*a* of the main shaft 121.

The central axes 52*a*, 62*a* of the cylindrical surfaces 50*b*, 60*b* of the bearing parts 50, 60 are eccentric to the central axis 22*a* of the inner circumferential surface 22*b* of the cylinder chamber 22.

As shown in FIG. 2, more specifically, in a section (having the same positional relation as that in the plan view of FIG. 2) orthogonal to the central axis 22*a* of the inner circumferential surface 22*b* of the cylinder chamber 22, the central axis 22*a* of the cylinder chamber 22 is defined as the origin, a straight line linking a central axis 28*a* of swing of the swing bushes 28, 28 and the central axis 22*a* of the cylinder chamber 22 is defined as a reference line L, an angle formed by a radius vector not shown that extends from the origin 22*a* and that revolves in a direction of the orbital motion of the roller part 26 with the reference line L in the direction of the orbital motion is defined as a central angle, and then the central axes 52*a*, 62*a* of the cylindrical surfaces 50*b*, 60*b* of the bearing parts 50, 60 are eccentric to the central axis 22*a* of the inner circumferential surface 22*b* of the cylinder chamber 22 at the central angle in the range from 270° to 360°.

The clearances between the cylindrical surfaces 50*b*, 60*b* of the bearing parts 50, 60 and the outer circumferential surface 121*b* of the main shaft 121 are sized to such an extent that the main shaft 121 is allowed to move so as to prevent the roller part 26 from colliding with the inner circumferential surface 22*b* of the cylinder chamber 22.

Figure 4:
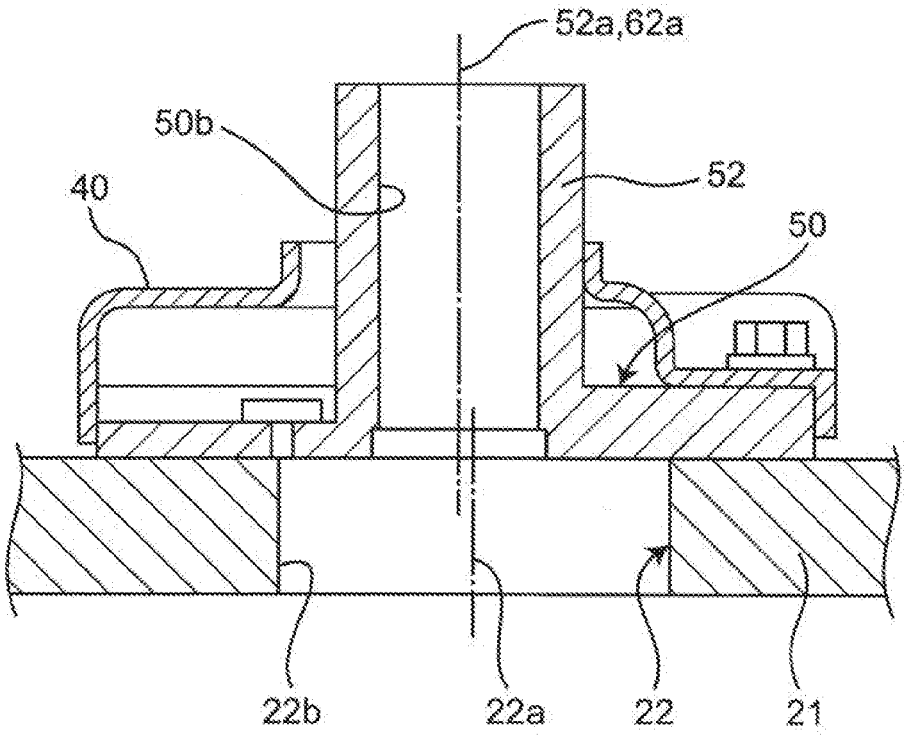
FIG. 4 is a sectional view showing a relation between a cylinder part and a bearing part.

According to the compressor having above configurations, it appears that the outer circumferential surface 26*c* of the roller part 26 is likely to collide with the inner circumferential surface 22*b* of the cylinder chamber 22 during operation because the relation $(\phi Ds-\phi Dr)/2<\epsilon$ holds, whereas the main shaft 121 of the shaft 12 moves by an amount corresponding to the clearances between the cylindrical surface 121*b* of the main shaft 121 and the cylindrical surfaces 50*b*, 60*b* of the bearing parts 50, 60 during operation because the central axes 52*a*, 62*a* of the cylindrical surfaces 50*b*, 60*b* of the bearing parts 50, 60 are eccentric to the central axis 22*a* of the cylindrical surface 22*b* of the cylinder chamber 22 as shown in FIG. 4 and because the bearing parts 50, 60 are the sliding bearings, so that the outer circumferential surface 26*c* of the roller part 26 is prevented from colliding with the inner circumferential surface 22*b* of the cylinder chamber 22 and so that the radial clearance (CP clearance) between the outer circumferential surface 26*c* of the roller part 26 and the inner circumferential surface 22*b* of the cylinder chamber 22 can be decreased.

The inner circumferential surface 22*b* of the cylinder chamber 22 and the outer circumferential surface 26*c* of the roller part 26 are cylindrical, and thus production costs and management costs can be reduced in comparison with configurations in which the inner circumferential surface 22*b* of the cylinder chamber 22 and the outer circumferential surface 26*c* of the roller part 26 are in noncircular shapes with a plurality of curvatures in section.

Thus reduction in leakage loss of the refrigerant and resultant improvement in efficiency can be attained by decrease in the clearance between the outer circumferential surface 26*c* of the roller part 26 and the inner circumferential surface 22*b* of the cylinder chamber 22 during operation and the production costs and the management costs for the cylinder 21 and the roller piston 25 can be reduced.

According to the embodiment, in which the clearances between the cylindrical surfaces 50*b*, 60*b* of the bearing parts 50, 60 and the outer circumferential surface 121*b* of the main shaft 121 are sized to such an extent that the main shaft 121 is allowed to move so as to prevent the roller part 26 from colliding with the inner circumferential surface 22*b* of the cylinder chamber 22 in spite of satisfaction of the relation $(\phi Ds-\phi Dr)/2<\epsilon$ and eccentricity of the central axes 52*a*, 62*a* of the cylindrical surfaces 50*b*, 60*b* of the bearing parts 50, 60 to the central axis 22*a* of the inner circumferential surface 22*b* of the cylinder chamber 22, movement of the main shaft 121 by the amount corresponding to the clearances prevents the outer circumferential surface 26*c* of the roller part 26 from colliding with the inner circumferential surface 22*b* of the cylinder chamber 22 and the reduction in the leakage loss of the refrigerant and the resultant improvement in the efficiency can be attained by the decrease in the radial clearance between the outer circumferential surface 26*c* of the roller part 26 and the inner circumferential surface 22*b* of the cylinder chamber 22.

Though the compressor is the so-called swing piston type compressor in which the roller part 26 and the blade part 27 are integrated, particularly, the outer circumferential, surface 26*c* of the roller part 26 is prevented from colliding with the inner circumferential surface 22*b* of the cylinder chamber 22 and the radial clearance between the outer circumferential surface 26*c* of the roller part 26 and the inner circumferential surface 22*b* of the cylinder chamber 22 can be decreased, so that the efficiency can be improved by the reduction in the leakage loss of the refrigerant.

In the section orthogonal, to the central axis 22*a* of the inner circumferential surface 22*b* of the cylinder chamber 22, as shown in FIG. 2, with definition of the central axis 22*a* of the cylinder chamber 22 as the origin, the straight line linking the central axis 28*a* of swing of the swing bushes 28, 28 and the central axis 22*a* of the cylinder chamber 22 as the reference line L, and the angle formed by the radius vector not shown that extends from the origin 22*a* and that revolves in the direction of the orbital motion of the roller part 26 with the reference line L in the direction of the orbital motion as the central angle, the central axes 52*a*, 62*a* of the cylindrical surfaces 50*b*, 60*b* of the bearing parts 50, 60 are eccentric to the central axis 22*a* of the inner circumferential surface 22*b* of the cylinder chamber 22 at the central angle in the range from 270° to 360° and, in other words, the roller part 26 is eccentric in a direction such that the roller part 26 comes closer to the cylindrical surface 22*b* of the cylinder part 21 at a revolution angle in the range of the central angle from 270° to 360° in the orbital motion of the roller part 26 which revolution angle is close to last of a compression stroke and which subjects the roller part 26 to the highest pressure of the refrigerant, so that the leakage loss of the refrigerant having the high pressure can effectively be reduced in particular by the decrease in the CP clearance between the inner circumferential surface 22*b* of the cylinder chamber 22 and the outer circumferential surface 26*c* of the roller part 26.

According to the compressor of the embodiment, the refrigerant that is made to flow into the cylinder chamber 22 is R32 and thus environmental impact of the refrigerant can be reduced. Though R32 has a tendency to have temperature easily increased by being compressed, the leakage of the refrigerant, in particular, the leakage of the refrigerant having the high pressure can be reduced as described above and thus increase in the temperature of the refrigerant that is caused by the leakage of the refrigerant having the high pressure to a suction side can be reduced.

According to the compressor having the above configurations, it appears that the roller part 26 is likely to collide with the inner circumferential surface 22*b* of the cylinder chamber 22 during operation because the relation $(\phi Ds-\phi Dr)/2<\epsilon$ holds, whereas the shaft 12 moves by the amount corresponding to the clearances between the shaft 12 and the front-side bearing part 50 and the rear-side bearing part 60 during operation because the center 52*a* of the front-side bearing part 50 and the center 62*a* of the rear-side bearing part 60 are eccentric to the center 22*a* of the cylinder chamber 22 and because the front-side bearing part 50 and the rear-side bearing part 60 are the sliding bearings. Thus the roller part 26 is prevented from colliding with the inner circumferential surface of the cylinder chamber 22 and the radial clearance (CP clearance) between the outer circumferential surface of the roller part 26 and the inner circumferential surface of the cylinder chamber 22 can be decreased.

In the plan view shown in FIG. 2, the center (central axis) 52*a* of the cylindrical surface 50*b* of the front-side bearing part 50 and the center (central axis) 62*a* of the cylindrical surface 60*b* of the rear-side bearing part 60 are eccentric to the center (central axis) 22*a* of the inner circumferential surface 22*b* of the cylinder chamber 22 in the direction with the central angle not smaller than 270° and not greater than 360°. Thus the center 52*a* of the front-side bearing part 50 and the center 62*a* of the rear-side bearing part 60 are made eccentric in the direction with a rotation angle of the roller piston at which the pressure of the refrigerant being compressed increases and thus the CP clearance corresponding to the rotation angle of the roller piston 25 can be decreased, so that the leakage loss of the refrigerant having the high pressure can effectively be reduced. Specific description will be given below.

Figure 3:
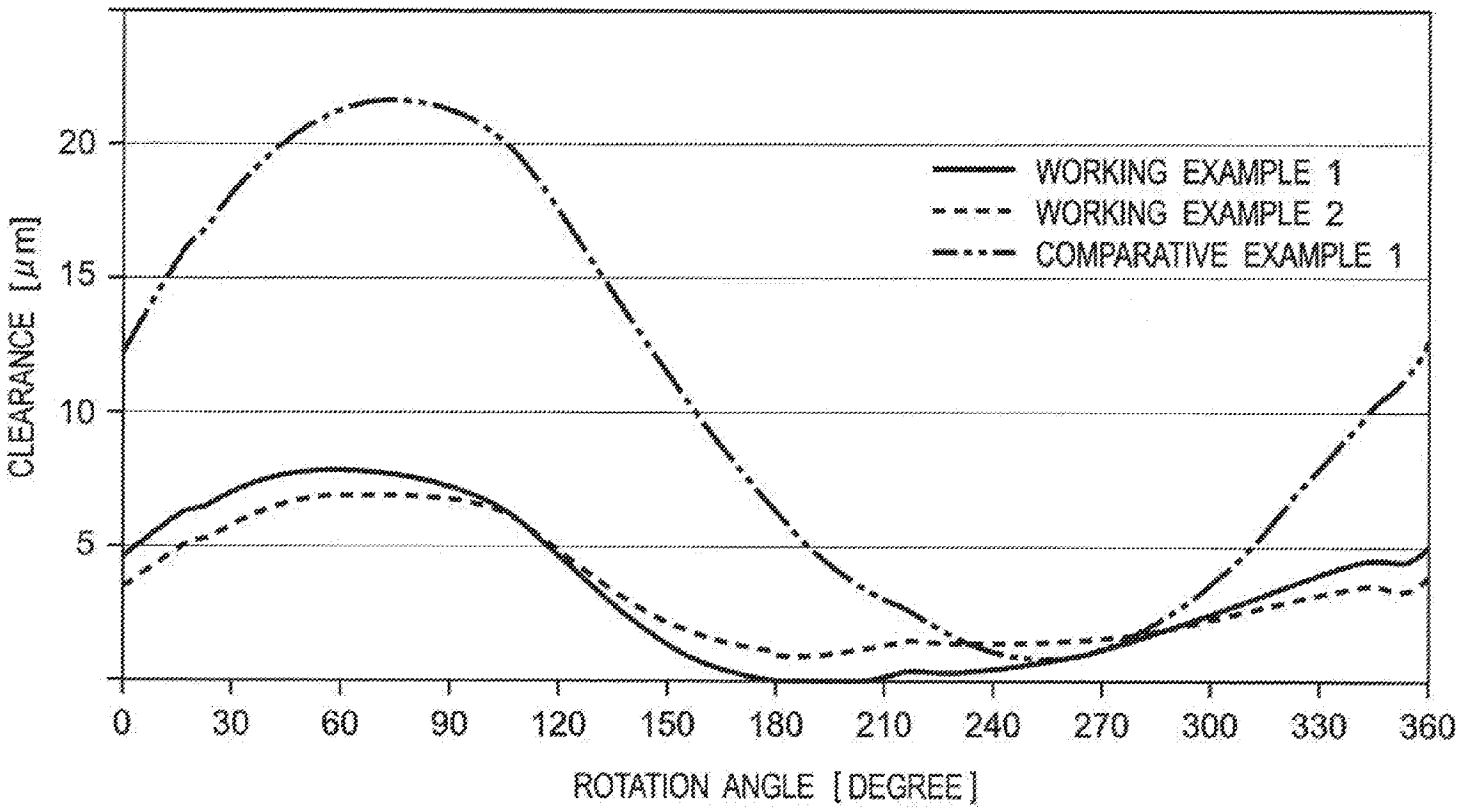
FIG. 3 is a graph showing relations between rotation angles of a roller piston and CP clearances.

FIG. 3 is a graph showing relations between the rotation angles of the roller piston 25 and the CP clearances. Therein, a solid line represents a working example 1, a dashed line represents a working example 2, and an imaginary line represents a comparative example 1.

In the working example 1, in which the relation $(\phi Ds-\phi Dr)/2<\epsilon$ holds, the center 52*a* of the front-side bearing part 50 and the center 62*a* of the rear-side bearing part 60 are eccentric to the center 22*a* of the cylinder chamber 22 in a direction with the central angle of 280°. According to the working example 1, fluctuations in the CP clearance during operation can be reduced and thus the leakage loss can be reduced.

In the working example 2, in which the relation $(\phi Ds-\phi Dr)/2<\epsilon$ holds, the center 52*a* of the front-side bearing part 50 and the center 62*a* of the rear-side bearing part 60 are eccentric to the center 22*a* of the cylinder chamber 22 in a direction with the central angle of 300°. According to the working example 2, the fluctuations in the CP clearance during operation can be reduced and thus the leakage loss can be reduced.

In the comparative example 1, in which a relation $(\phi Ds-\phi Dr)/2>\epsilon$ holds, a center of a front-side bearing part and a center of a rear-side bearing part are eccentric with respect to a center of a cylinder chamber in a direction with the central angle of 270°. According to the comparative example, the fluctuations in the CP clearance during operation increase and thus the leakage loss increases. In the comparative example, the relation $(\phi Ds-\phi Dr)/2>\epsilon$ is assumed because there have conventionally been great variations in inside diameter of the cylinder chamber and outside diameter of a roller part due to poor working accuracies. To sum up, unless the relation $(\phi Ds-\phi Dr)/2>\epsilon$ holds, the variations among products cannot be absorbed by the CP clearance and there is a fear that the roller part may collide with the inner circumferential surface of the cylinder chamber.

In the working examples 1 and 2, by contrast, the relation $(\phi Ds-\phi Dr)/2<\epsilon$ is assumed because the variations in the inside diameter of the cylinder chamber 22 and the outside diameter of the roller part 26 are decreased nowadays by improved, working accuracies. To sum up, even if the relation $(\phi Ds-\phi Dr)/2<\epsilon$ holds, the variations among products can be absorbed by the CP clearance and there is no fear that the roller part 26 may collide with the inner circumferential surface of the cylinder chamber 22.

Figure 5:
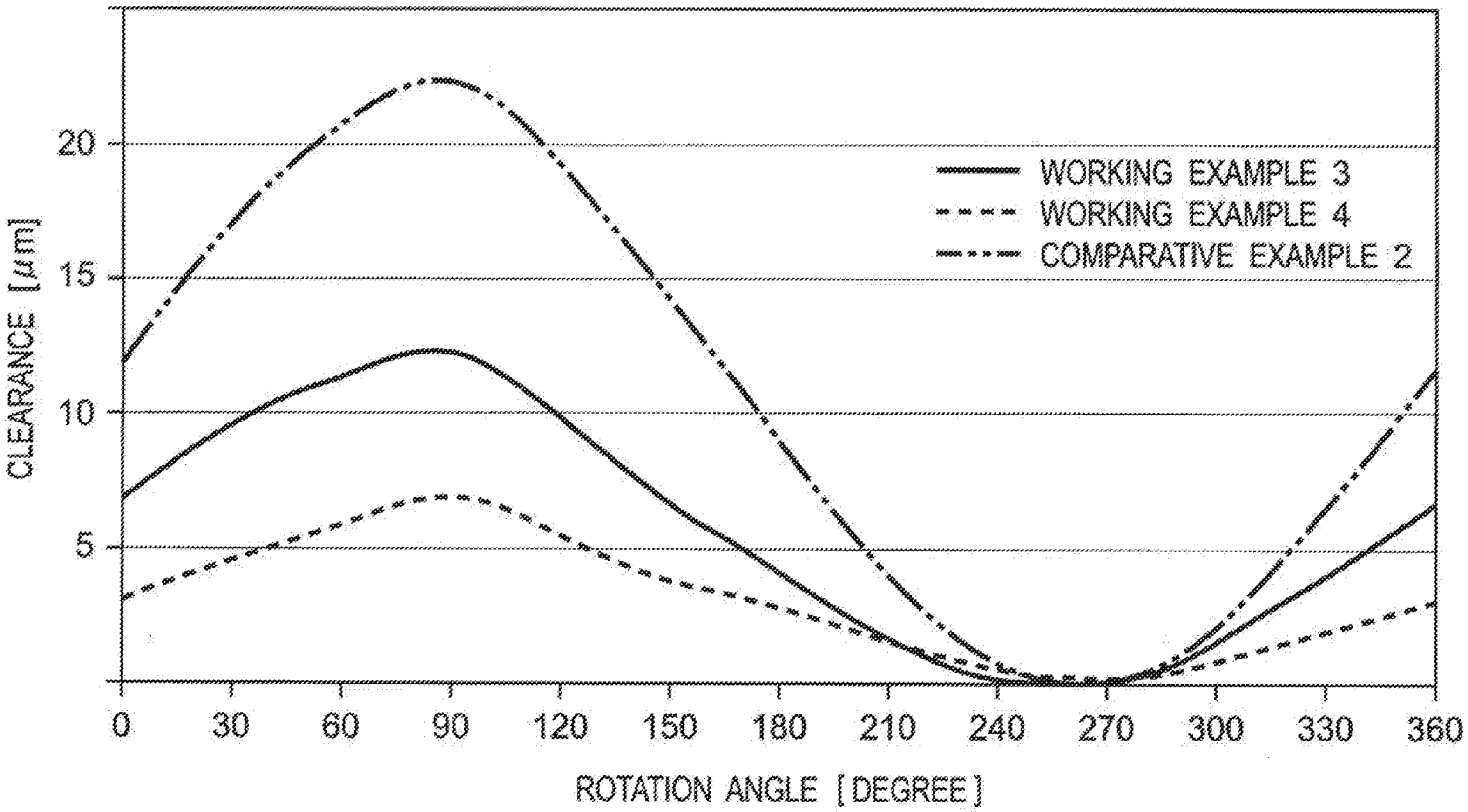
FIG. 5 is a graph showing relations between rotation angles of a roller piston and CP clearances in a two-cylinder compressor.

FIG. 5 is a graph showing relations between rotation angles of a roller piston and the CP clearances in a two-cylinder compressor not shown. Therein, a solid line represents a working example 3, a dashed line represents a working example 4, and an imaginary line represents a comparative example 2. The two-cylinder compressor is different from the configurations of FIG. 1 in that two cylinders are provided on both sides of an intermediate plate and in that a shaft has two eccentric parts but other configurations thereof are similar to the configurations of FIG. 1.

The working examples 3, 4, and the comparative example 2 correspond to the working examples 1, 2, and the comparative example 1. In the working examples 3, 4, and the comparative example 2, in other words, the two-cylinder compressor is substituted for the one-cylinder compressor of the working examples 1, 2, and the comparative example 1.

As is understood from FIG. 5, the CP clearances in the working examples 3 and 4 are greatly decreased in comparison with the CP clearance in the comparative example 2 just as the CP clearances in the working examples 1 and 2 are greatly decreased in comparison with the CP clearance in the comparative example 1.

According to the compressor having the above configurations, as shown in FIG. 2, the inner circumferential surface 22*b* of the cylinder chamber 22 is in shape of the perfect circle in section and the outer circumferential surface 26*c* of the roller part 26 is also in shape of the perfect circle in section and thus the production costs and the management costs can be reduced in comparison with the configurations in which the inner circumferential surface of the cylinder chamber 22 and the outer circumferential surface of the roller part 26 are in noncircular shapes with a plurality of curvatures in section. In short, machining for the inner circumferential surface of the cylinder chamber 22 does not require any processing machine subjected to advanced NC. In addition, the CP clearance can be made minute and uniform without management of the shape of the machined cylinder 21.

According to the compressor having the above configurations, consequently, the reduction in the leakage loss of the refrigerant and the improvement in the efficiency can be attained by the decrease in the clearance between the outer circumferential surface 26*c* of the roller part 26 and the inner circumferential surface 22*b* of the cylinder chamber 22 during operation and the production costs and the management costs for the cylinder 21 and the roller piston 25 can be reduced.

According to the compressor having the above configurations, the refrigerant that is made to flow into the cylinder chamber 22 is R32 and thus the environmental impact of the refrigerant can be reduced. Though R32 has the tendency to have compression temperature easily increased, the embodiment reduces the leakage of the refrigerant and thereby decreases the temperature of the refrigerant that is discharged from the cylinder 21.

In case where the refrigerant leaks out, by contrast, the temperature of the refrigerant that is discharged from the cylinder 21 increases. As a result, members that form the compressor might undergo thermal degradation, thermal expansion, and the like and thereby might undergo quality deterioration.

Second Embodiment

Figure 6:
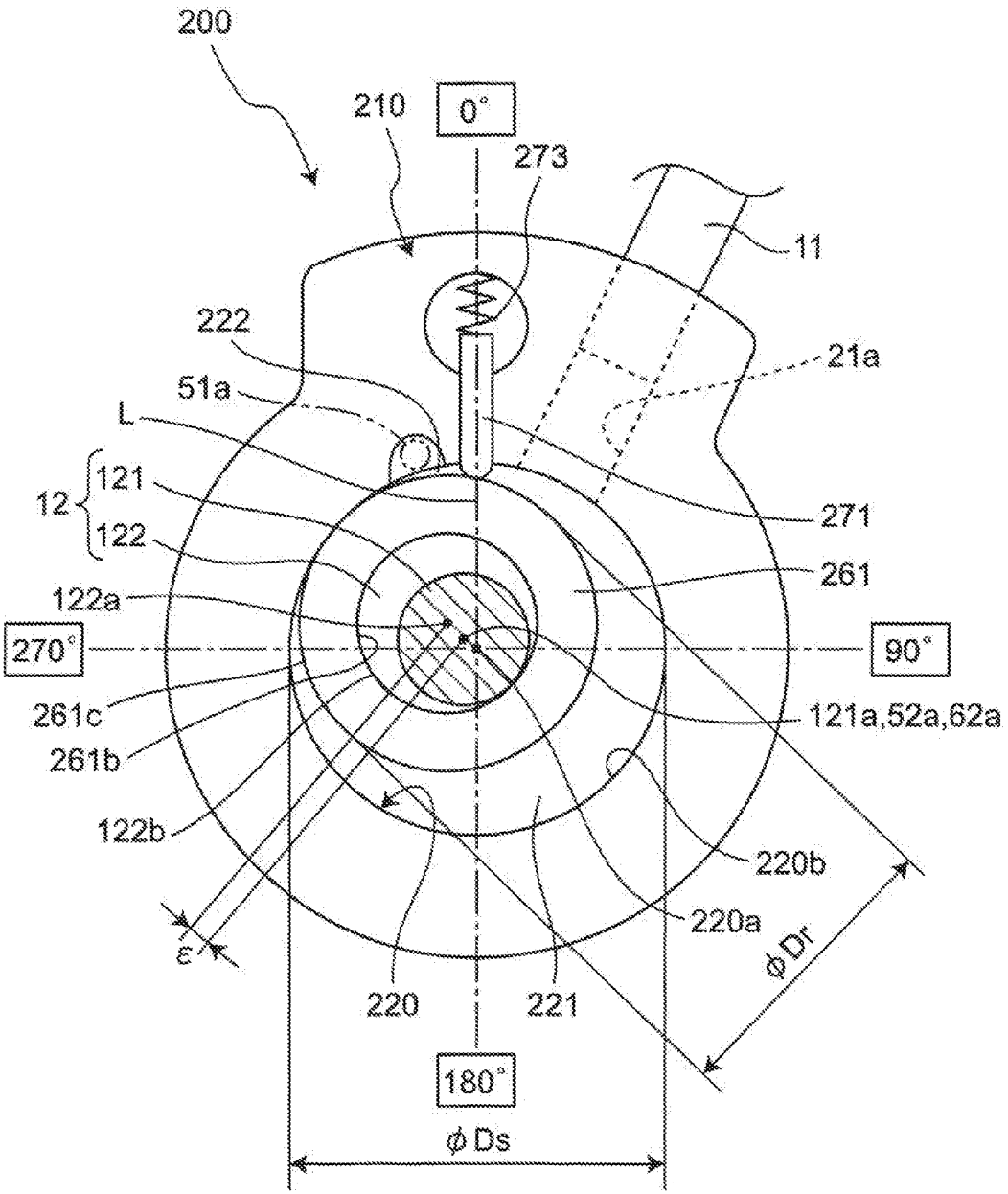
FIG. 6 is a plan view of a compression element of a compressor in accordance with a second embodiment of the invention.

FIG. 6 is a plan view of a compression element 200 that is a main part of a so-called rotary piston type compressor in accordance with a second embodiment. The compressor of the second embodiment is different from the compressor of the first embodiment shown in FIGS. 1, 2, and 4 only in configurations of the compression element 200 but other configurations thereof are the same as those of the first embodiment and FIGS. 1 and 4 will be reused for the configurations.

Components of the compression element 200 of the second embodiment shown in FIG. 6 that are the same as components of the compression element 2 of the first embodiment shown in FIG. 2 are provided with the same reference characters as those for the components shown in FIG. 2 and detailed description thereof is omitted.

As shown in FIG. 6, a roller part 261 is separate from a blade part 271, the blade part 271 biased by a spring 273 and by air pressure protrudes into a cylinder chamber 220 of a cylinder 210 so as to be capable of reciprocating, and an extremity of the blade part 271 is in sliding contact with an outer circumferential surface 261*c* of the roller part 261 that is a cylinder surface.

Therein, the relation $(\phi Ds-\phi Dr)/2<\epsilon$ is satisfied, in which $\phi Ds$ is an inside diameter of an inner circumferential surface 220*b* of the cylinder chamber 220 that is a substantially cylindrical surface, $\phi Dr$ being an outside diameter of the outer circumferential surface 261*c* of the roller part 261, $\epsilon$ being the eccentricity of the central axis 122*a* of the eccentric part 122 to the central axis 121*a* of the main shaft 121.

The central axes 52*a*, 62*a* of the cylindrical surfaces 50*b*, 60*b* of the bearing parts 50, 60 that are the sliding bearings are eccentric to a central axis 220*a* of the inner circumferential surface 220*b* of the cylinder chamber 220.

As shown in FIG. 6, more specifically, in a section (having the same positional relation as that in the plan view of FIG. 6) orthogonal to the central axis 220*a* of the inner circumferential surface 220*b* of the cylinder chamber 220, the central axis 220*a* of the cylinder chamber 220 is defined as an origin, a straight line linking a center plain between both side surfaces of the blade part 271 and the central axis 220*a* of the cylinder chamber 220 is defined as a reference line L, an angle formed by a radius vector not shown that extends from the origin 220*a* and that revolves in a direction of an orbital motion of the roller part 261 with the reference line L in the direction of the orbital motion is defined as a central angle, and then the central axes 52*a*, 62*a* of the cylindrical surfaces 50*b*, 60*b* of the bearing parts 50, 60 are eccentric to the central axis 220*a* of the inner circumferential surface 220*b* of the cylinder chamber 220 at the central angle in the range from 270° to 360°.

The clearances between the cylindrical surfaces 50*b*, 60*b* of the bearing parts 50, 60 and the outer circumferential surface 121*b* of the main shaft 121 are sized to such an extent that the main shaft 121 is allowed to move so as to prevent the roller part 261 from colliding with the inner circumferential surface 220*b* of the cylinder chamber 220.

In the compressor having above configurations, it appears that the outer circumferential surface 261*c* of the roller part 261 is likely to collide with the inner circumferential surface 220*b* of the cylinder chamber 220 during operation because the relation $(\phi Ds-\phi Dr)/2<\epsilon$ holds, whereas the main shaft 121 of the shaft 12 during operation moves by an amount corresponding to the clearances between the cylindrical surface 121*b* of the main shaft 121 and the cylindrical surfaces 50*b*, 60*b* of the bearing parts 50, 60 because the central axes 52*a*, 62*a* of the cylindrical surfaces 50*b*, 60*b* of the bearing parts 50, 60 are eccentric to the central axis 220*a* of the cylindrical surface 220*b* of the cylinder chamber 220 as shown in FIG. 6 and because the bearing parts 50, 60 are the sliding bearings, so that the outer circumferential surface 261*c* of the roller part 261 is prevented from colliding with the inner circumferential surface 220*b* of the cylinder chamber 220 and so that a radial clearance (CP clearance) between the outer circumferential surface 261*c* of the roller part 261 and the inner circumferential surface 220*b* of the cylinder chamber 220 can be decreased.

The inner circumferential surface 220*b* of the cylinder chamber 220 and the outer circumferential surface 261*c* of the roller part 261 are substantially cylindrical, and thus production costs and management costs can be reduced in comparison with configurations in which the inner circumferential surface 220*b* of the cylinder chamber 220 and the outer circumferential surface 261*c* of the roller part 261 are in noncircular shapes with a plurality of curvatures in section.

Thus reduction in the leakage loss of the refrigerant and resultant improvement in the efficiency can be attained by decrease in the clearance between the outer circumferential surface 261*c* of the roller part 261 and the inner circumferential surface 220*b* of the cylinder chamber 220 during operation and the production, costs and the management costs for the cylinder 210 and the roller part 261 can be reduced.

The clearances between the cylindrical surfaces 50*b*, 60*b* of the bearing parts 50, 60 and the outer circumferential surface 121*b* of the main shaft 121 are sized to such an extent that the main shaft 121 is allowed to move so as to prevent the roller part 261 from colliding with the inner circumferential surface 220*b* of the cylinder chamber 220 in spite of the satisfaction of the relation $(\phi Ds-\phi Dr)/2<\epsilon$ and eccentricity of the central axes 52*a*, 62*a* of the cylindrical surfaces 50*b*, 60*b* of the bearing parts 50, 60 to the central axis 220*a* of the inner circumferential surface 220*b* of the cylinder chamber 220, thus the movement of the main shaft 121 by the amount corresponding to the clearances prevents the outer circumferential surface 261*c* of the roller part 261 from colliding with the inner circumferential surface 220*b* of the cylinder chamber 220, and the reduction in the leakage loss of the refrigerant and the resultant improvement in the efficiency can be attained by the decrease in the radial clearance between the outer circumferential surface 261*c* of the roller part 261 and the inner circumferential surface 220*b* of the cylinder chamber 220.

The invention is not limited to the embodiments described above and modifications in design may be made within such a scope as not to depart from the purport of the invention.

Though the centers of the front-side bearing part and the rear-side bearing part are eccentric to the center of the cylinder chamber in the direction with the central angle not smaller than 270° and not greater than 360° in the embodiments, the centers may be eccentric in a direction with the central angle not smaller than 180° and not greater than 270°.

Though R32 is used as the refrigerant in the embodiments, carbon dioxide, HC, HFC such as R410A, HCFC such as R22 or the like may be used as the refrigerant.

Though one cylinder or two cylinders are provided in the embodiments, two or more cylinders may be provided.

Though the blade part is integrally fixed to the roller part in the roller piston in the embodiment, the blade part may be separate from the roller part.

Though a function of the eccentric part of the shaft as a bearing for supporting the roller part of the roller piston has not been described for the embodiments, the eccentric part that is used as a sliding bearing causes the roller part to move by an amount corresponding to a clearance between the roller part and the eccentric part during operation and further prevents the roller part from colliding with the inner surface of the cylinder chamber.

What is claimed is:

1. A compressor comprising:

a cylinder including a cylinder chamber with an inner circumferential surface that is a substantially cylindrical surface;

a shaft including a main shaft and an eccentric part, which is eccentric relative to the main shaft;

a roller part having an inner circumferential surface fitted on an outer circumferential surface of the eccentric part, the outer circumferential surface being a substantially cylindrical surface, and being placed in the cylinder chamber so as to make an orbital motion;

a blade part along with the roller part partitioning inside of the cylinder chamber into a low-pressure chamber and a high-pressure chamber; and bearing parts fixed to the cylinder and respectively including cylindrical surfaces supporting the main shaft, a relation $(\phi Ds-\phi Dr)/2<\epsilon$ being satisfied, in which $\phi Ds$ is an inside diameter of the inner circumferential surface of the cylinder chamber, $\phi Dr$ is an outside diameter of the outer circumferential surface of the roller part, and $\epsilon$ is an eccentricity of a central axis of the eccentric part relative to a central axis of the main shaft, central axes of the cylindrical surfaces of the bearing parts being eccentric relative to a central axis of the inner circumferential surface of the cylinder chamber, and the bearing parts being sliding bearings.

2. The compressor as claimed in claim 1, wherein clearances between the cylindrical surfaces of the bearing parts and the outer circumferential surface of the main shaft are sized such that the main shaft is moveable so as to prevent the roller part from colliding with the inner circumferential surface of the cylinder chamber.

3. The compressor as claimed in claim 1, wherein the roller part and the blade part are integrated to form a roller piston, and both side surfaces of the blade part are swingably supported by swing bushes.

4. The compressor as claimed in claim 1, wherein the roller part and the blade part are separated, the blade part protrudes into the cylinder chamber so as to be capable of reciprocating, and an extremity of the blade part is in sliding contact with the outer circumferential surface of the roller part.

5. The compressor as claimed in claim 3, wherein the central axes of the cylindrical surfaces of the bearing parts are eccentric relative to the central axis of the inner circumferential surface of the cylinder chamber at a central angle in a range from 270° to 360° in a section orthogonal to the central axis of the inner circumferential surface of the cylinder chamber with the central axis of the cylinder chamber defined as an origin, with a straight line linking a central axis of swing of the swing bushes and the central axis of the cylinder chamber or a straight line linking a center plain between both the side surfaces of the blade part separate from the roller part and the central axis of the cylinder chamber defined as a reference line, and with an angle formed by a radius vector that extends from the origin and that revolves in a direction of the orbital motion of the roller part with the reference line in the direction of the orbital motion defined as the central angle.

6. The compressor as claimed in claim 1, wherein refrigerant that is made to flow into the cylinder chamber is R32.

7. The compressor as claimed in claim 4, the central axes of the cylindrical surfaces of the bearing parts are eccentric relative to the central axis of the inner circumferential surface of the cylinder chamber at a central angle in a range from 270° to 360° in a section orthogonal to the central axis of the inner circumferential surface of the cylinder chamber with the central axis of the cylinder chamber defined as an origin, with a straight line linking a central axis of swing of the swing bushes and the central axis of the cylinder chamber or a straight line linking a center plain between both the side surfaces of the blade part separate from the roller part and the central axis of the cylinder chamber defined as a reference line, and with an angle formed by a radius vector that extends from the origin and that revolves in a direction of the orbital motion of the roller part with the reference line in the direction of the orbital motion defined as the central angle.

* * * * *